US005356079A

United States Patent [19]

Rahbar

[11] Patent Number: 5,356,079

[45] Date of Patent: Oct. 18, 1994

[54] FUEL INJECTOR SNAP-LOCK FILTER-RETAINER

[75] Inventor: Mehran K. Rahbar, Chesapeake, Va.

[73] Assignee: Siemens Automotive L.P., Auburn Hills, Mich.

[21] Appl. No.: 156,556

[22] Filed: Nov. 23, 1993

[51] Int. Cl.[5] ..... B05B 17/00

[52] U.S. Cl. ..... 239/585.1; 239/590; 239/600; 239/DIG. 23

[58] Field of Search ..... 239/DIG. 23, 590, 590.3, 239/585.1–585.5, 600; 285/921; 210/416.4, 251

[56] References Cited

U.S. PATENT DOCUMENTS

| | | | |
|---|---|---|---|
| 3,827,734 | 8/1974 | Brown | 285/921 X |
| 3,924,881 | 12/1975 | O'Connor | 285/921 X |
| 3,958,719 | 5/1976 | Ward | 285/921 X |
| 4,527,745 | 7/1985 | Butterfield et al. | 239/590.3 X |
| 4,700,891 | 10/1987 | Hans et al. | 239/585.5 X |
| 4,826,082 | 5/1989 | Greiner et al. | 239/585.4 |
| 4,946,107 | 8/1990 | Hunt | 239/585.4 |
| 5,172,724 | 12/1992 | Tsuzuki et al. . | |

FOREIGN PATENT DOCUMENTS

| | | | |
|---|---|---|---|
| 2151701 | 7/1985 | United Kingdom | 239/585.5 |

*Primary Examiner*—Andres Kashnikow
*Assistant Examiner*—Lesley D. Morris
*Attorney, Agent, or Firm*—George L. Boller; Russel C. Wells

[57] ABSTRACT

A filter-retainer assembly performs both the function of filtering the inlet fuel flow and retaining the inlet tube O-ring of a top-feed fuel injector of the type commonly used in fuel injection systems of internal combustion engines. The assembly has a snap-on, snap-off feature.

4 Claims, 1 Drawing Sheet

FUEL INJECTOR SNAP-LOCK FILTER-RETAINER

FIELD OF THE INVENTION

This invention relates to electrically operated fuel injectors that are used in fuel injection systems of internal combustion engines.

BACKGROUND AND SUMMARY OF THE INVENTION

Fuel injectors that are of the type commonly known as top-feed fuel injectors typically comprise a metallic inlet connector tube via which fuel enters the fuel injector. It is also typical to have an elastomeric O-ring disposed around the outside of the inlet connector tube for forming a fluid-tight joint between the fuel injector and a cup, or socket, of a fuel rail into which the inlet connector tube is inserted so that the fuel injector can be supplied with fuel. In order to assure that the O-ring will stay on the inlet connector tube, the inlet connector tube comprises a retainer ring disposed over the O-ring. One common practice is to join the retainer ring to the inlet connector tube, such as by staking. Instead of using a separate retainer ring, It is also known to flare the entrance end of the inlet connector tube radially outwardly so that it will have radial interference with the O-ring. The inlet connector tube also typically contains a filter assembly that is assembled onto its entrance for filtering certain foreign matter from fuel entering the fuel injector.

The present invention relates to an improvement in a fuel injector comprising a new and unique integration of the fuel filtering and O-ring retention functions. The invention provides advantage over prior fuel injectors in a number of ways: it reduces the number of individual parts; it reduces the risk of contaminant generation; it facilitates assembly; and it can provide for fuel injector identification by color-coding.

In certain prior constructions, the filter assembly comprised a metal collar press-fitted to the entrance of the inlet connector tube. Such metal-to-metal pressing has the potential for generating undesired contaminant that could adversely affect performance. Such contaminant would be additional to any contaminant generated by operations used to join the retainer ring to the inlet connector tube. The press-fitting of the filter assembly to the inlet connector tube may also make it difficult to accurately control the filter assembly's insertion depth into the inlet connector tube. The present invention avoids these potential disadvantages.

Details of the invention, along with its general and specific principles, will appear in the ensuing description and claims which are accompanied by a drawing. The drawing discloses a presently preferred embodiment of the invention according to the best mode contemplated at this time for carrying out the invention.

DESCRIPTION OF THE PREFERRED EMBODIMENT

Figure 1:
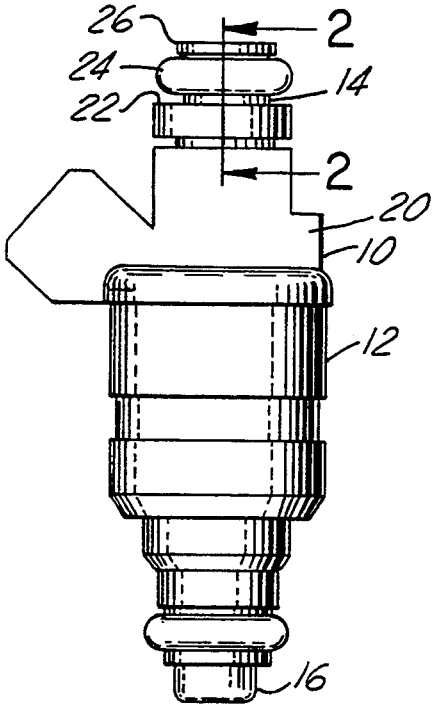
FIG. 1 is longitudinal view of a representative fuel injector, but containing the invention.
Figure 3:
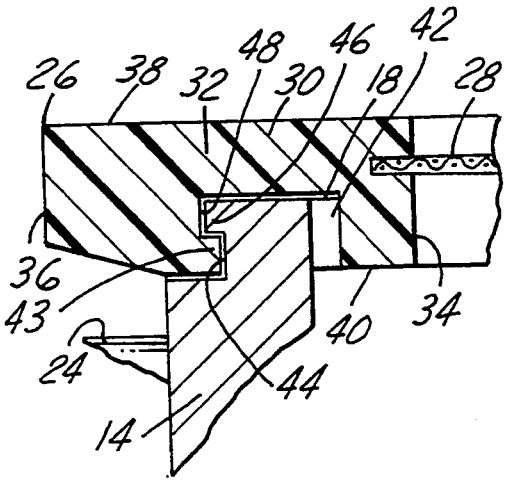
FIG. 3 is an enlarged fragmentary view of a portion of FIG. 2.
Figure 2:
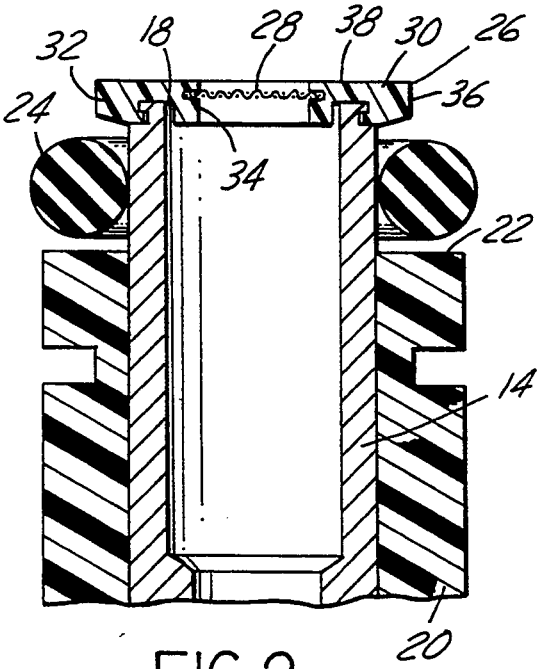
FIG. 2 is an enlarged fragmentary cross sectional view in the direction of arrows 2—2 in FIG. 1.

The drawing FIGS. 1–3 show an electrically operated top-feed fuel injector 10 comprising a body 12 having a tubular-walled inlet connector tube 14 at one axial end via which fuel is introduced into the fuel injector and a nozzle 16 at the opposite axial end via which fuel is injected from the fuel injector. Inlet connector tube 14 is metal and has an entrance 18 through which fuel passes upon entering. Body 12 comprises a non-metallic cover 20 covering at least an upper portion of the body, including covering inlet connector tube 14 to a point short of entrance 18 so as to leave an axially-facing shoulder 22 that axially faces, but is spaced from, entrance 18. An elastomeric O-ring seal 24 is disposed around the outside of inlet connector tube 14 axially between entrance 18 and shoulder 22, and a filter-retainer assembly 26 is assembled onto inlet connector tube 14 at entrance 18 for both filtering certain entrained matter from fuel entering the entrance and retaining O-ring 24 on tube 14.

Filter-retainer assembly 26 comprises filter media, in the form of a screen mesh, 28 carried by a frame 30. Frame 30 is preferably fabricated of fuel-tolerant, injection-molded plastic and comprises a ring 32 having a radially inwardly facing I.D. surface 34, a radially outwardly facing O.D. surface 36, and axially facing surfaces 38, 40 joining the I.D. and O.D. surfaces 34, 36. Surface 40 fits over the wall of inlet connector tube 14 at entrance 18 so that I.D. surface 34 is radially inwardly of the wall of tube 14 and O.D. surface 36 is radially outwardly of the wall. Surface 40 comprises an axially open circular annular groove 42 within which the wall of tube 14 is received at entrance 18. Frame 30 comprises means providing for the snap-on, snap-off attachment of filter-retainer assembly 26 to the tube. Ring 32 disposes O.D. surface 36 sufficiently radially outwardly to radially overlap O-ring 24, thereby presenting an interference for keeping the O-ring on tube 14.

Figure 4:
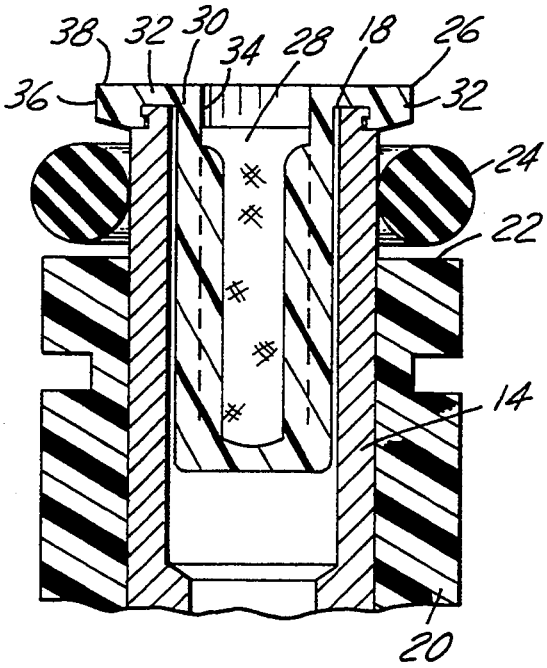
FIG. 4 is a view similar to FIG. 2 showing an alternate form.

Inlet connector tube 14 provides for the snap-on, snap-off attachment of filter assembly 26 to the inlet connector tube by means of mutually interlocking tongues and grooves. A radially inwardly directed tongue 43 of frame 30 is received in a radially Outwardly open groove 44 in inlet connector tube 14 while a radially outwardly directed tongue 46 of tube 14 is received in a radially inwardly open groove 48 in frame 30. Each tongue and groove is circumferentially continuous, but may alternatively be discontinuous such that there are multiple discrete tongues and grooves at various locations around the circumference providing multiple individual snap-locks. The material of frame 30 has a certain flexibility that allows its tongue (or tongues) to flex in order for it to snap on and off tube 14 with relatively low installation and removal forces. FIG. 2 shows the filter screen in a surface-mount configuration while FIG. 4 shows an inserted screen configuration. Because of the snap-on, snap-off feature with the accompanying positive abutment stop upon installation, the insertion depth of the filter media into tube 14 can be accurately controlled. The injection molding of 30 frame allows for it to be readily colored to a particular color-coding for identifying a particular size of filter-retainer assembly.

What is claimed is:

1. A top feed electrically operated fuel injector comprising a body having an inlet connector tube at one axial end via which fuel is introduced into the fuel injector and a nozzle at an opposite axial end via which fuel is injected from the fuel injector, said inlet connector tube being metal and having an entrance through which fuel passes upon entering said inlet connector tube, said inlet connector tube comprising a tubular wall, said body comprising a non-metallic cover covering at least a portion of said body, including covering said inlet connector tube to a point short of said inlet connector tube's entrance so as to leave a shoulder that axially faces, but is spaced from, said entrance, an elastomeric O-ring seal disposed around the outside of said inlet connector tube between said entrance and said shoulder, and a filter-retainer assembly assembled onto said inlet connector tube at said entrance for filtering certain entrained matter from fuel entering said entrance, said filter-retainer assembly comprising filter media carried by a frame, said frame comprising a ring having a radially inwardly raping I.D. surface, a radially outwardly facing O.D. surface, and axially facing surfaces joining said I.D. and O.D. surfaces, one of said axially facing Surfaces fitting over the wall of said inlet connector tube at said entrance thereof so that said I.D. surface is radially inwardly of said wall and said O.D. surface is radially outwardly of said wall, said one surface comprising an axially open circular annular groove within which said wall is received at said entrance, and said frame comprising means providing for a snap-on, snap-off attachment of said filter-retainer assembly to, said inlet connector tube, said ring having said O.D. surface disposed sufficiently radially outwardly to radially overlap said O-ring.

2. A fuel injector as set forth in claim 1 in which said means providing for the snap-on, snap-off attachment of said filter-retainer assembly to said inlet connector tube comprises radially directed tongue means on one of said inlet connector tube and ring that is received in radially open groove means in the other of said inlet connector tube and ring.

3. A fuel injector as set forth in claim 2 in which said radially directed tongue means comprises a radially inwardly directed tongue on said inlet connector tube and said radially open groove means comprises a radially outwardly open groove in said ring.

4. A fuel injector as set forth in claim 3 in which said tongue and groove are circumferentially continuous.

* * * * *